United States Patent [19]

Immel

[11] Patent Number: 4,882,911

[45] Date of Patent: Nov. 28, 1989

[54] APPARATUS FOR REMOVING CONDENSATE WATER FROM A COMPRESSOR-OPERATED COOLING DEVICE

[75] Inventor: Manfred Immel, Mittenaar, Fed. Rep. of Germany

[73] Assignee: Rittal-Werk Rudolf Loh GmbH & Co. KG, Fed. Rep. of Germany

[21] Appl. No.: 255,762

[22] Filed: Oct. 11, 1988

[30] Foreign Application Priority Data

Oct. 21, 1987 [DE] Fed. Rep. of Germany ..... 3735551

[51] Int. Cl.[4] ..... F25D 21/14

[52] U.S. Cl. ..... 62/288; 62/291; 62/314; 261/119.1

[58] Field of Search ..... 62/285, 288, 289, 291, 62/314; 261/119.1; 98/105, 109

[56] References Cited

U.S. PATENT DOCUMENTS

| | | | |
|---|---|---|---|
| 1,121,845 | 12/1914 | Kallusch | 261/119.1 X |
| 3,146,609 | 9/1964 | Engalitcheff | 62/314 X |
| 3,596,475 | 8/1971 | Berger | 62/291 X |
| 3,918,271 | 11/1975 | Whisler | 62/285 |
| 4,006,674 | 2/1977 | Culver | 98/109 X |
| 4,038,347 | 7/1977 | Mickley | 261/119.1 X |
| 4,089,187 | 5/1978 | Schumacher et al. | 62/289 |

FOREIGN PATENT DOCUMENTS

| | | |
|---|---|---|
| 8123465 | 3/1982 | Fed. Rep. of Germany . |
| 8318803 | 6/1983 | Fed. Rep. of Germany . |
| 1460450 | 1/1977 | United Kingdom . |

*Primary Examiner*—William E. Tapolcai
*Attorney, Agent, or Firm*—Thomas W. Speckman; Douglas H. Pauley

[57] ABSTRACT

The invention relates to a cooling device having an evaporator, a blower with an outlet connecting piece, a condenser, and a compressor. A condensate collecting pan is positioned below the evaporator. The collected condensate water flows from the condensate collecting pan through a discharge pipe. In order for relatively large quantities of accumulating condensate water to be removed from the cooling device, the condensate water flows from the discharge pipe into a condensate collecting pan positioned below and downstream of an outlet connecting piece of the blower which discharges a warm air current. The warm air current of the blower flows to an outlet hole through an air channel which is connected to an outlet connecting piece of the blower.

4 Claims, 1 Drawing Sheet

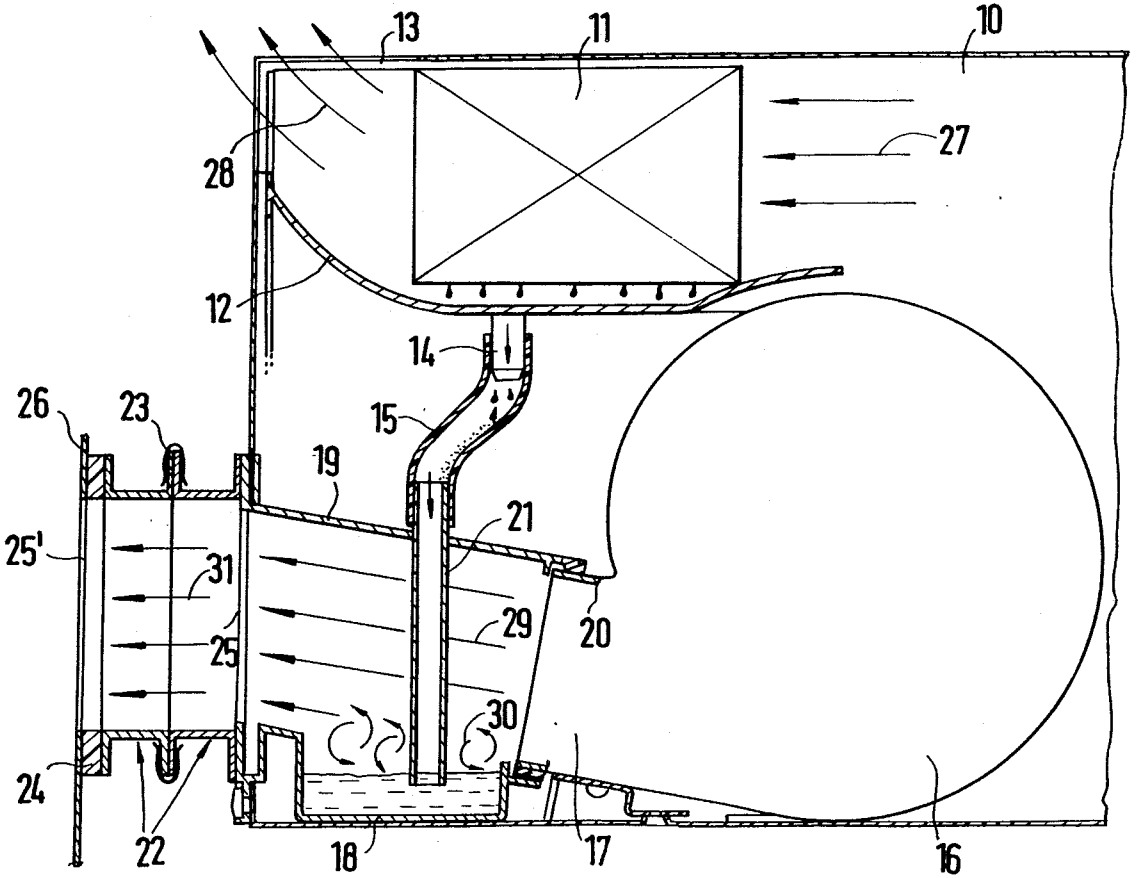
10
27
11
13
28
12
14
15
16
20
21
29
30
17
18
19
25
31
23
22
26
25'
24

APPARATUS FOR REMOVING CONDENSATE WATER FROM A COMPRESSOR-OPERATED COOLING DEVICE

BACKGROUND OF THE INVENTION

1. Field of the Invention

The invention relates to an apparatus for removing condensate water from a compressor-operated cooling device having an evaporator with a condensate collecting pan mounted below the evaporator. Condensate water accumulated during the condensation operation of the evaporator is conveyed to a drip pan which is mounted on a base plate below the condensate collecting pan next to an outlet hole in one wall of the cooling device. A blower is mounted to the side of the drip pan lying opposite the outlet hole. During the condensation operation the blower passes a warm air current over the surface of the condensate water collected in the drip pan, in the direction of the outlet hole.

2. Description of the Prior Art

In a device disclosed in British patent specification GB-PS No. 14 60 450, the condensate water is not blown laterally and outward from the drip pan, in the form of fluid droplets, and out of the cooling device.

German patent DE-GM No. 81 23 465 teaches a cooling device for a control panel in which a desired humidity level is maintained in the control panel. In such cooling device, condensate water is neither quickly nor reliably eliminated from the cooling device or from the control panel.

SUMMARY OF THE INVENTION

It is an object of this invention to provide an apparatus in which relatively large quantities of accumulating condensate water can be rapidly and reliably eliminated from a cooling device.

This invention includes a pan which is integrated, as a pan-shaped concavity, into the lower side of a closed air channel. The closed air channel is tightly connected with the outlet of a blower at one end and with an outlet hole at the opposite end. The blower provides a warm air current at a velocity sufficient to remove fluid droplets from the surface of the condensate water which is accumulated in the drip pan.

The warm air current produced by the blower is passed over the surface of condensate water in the condensate collecting pan. Since the warm air current has a high velocity, the collected condensate water is not only heated but air eddies also arise above the condensate collecting pan and cause the condensate water to evaporate. Fluid droplets are entrained from the fluid, vortexed upward, and when mixed with the warm air current, are carried outside of the closed air channel through the outlet hole of the cooling device. The combination of the heat of the warm air current and turbulence over the condensate water can eliminate relatively large quantities of accumulated condensate water from the cooling device.

According to one embodiment of this invention, the condensate collecting pan has an outlet connecting pipe. An inlet pipe extends across the internal space of the air channel from an upper side of the air channel to the drip pan mounted on the lower side of the air channel. The inlet pipe is connected with the outlet connecting pipe from the condensate collecting pan by a flexible tube. Condensate water accumulated in the condensate collecting pan flows into the drip pan.

In one embodiment according to this invention, the outlet connection of the blower, the outlet hole and the air channel have a circular or rounded cross section. Also, the air channel is slightly inclined to the outlet hole such that condensate water or fluid droplets in the air channel between the outlet hole and the drip pan can flow back into the drip pan after the blower is switched off.

BRIEF DESCRIPTION OF THE DRAWING

The invention is illustrated in greater detail in the drawing which shows a cross-sectional front view of the device of this invention.

DESCRIPTION OF THE PREFERRED EMBODIMENTS

Since a cooling device having an evaporator, a blower, a condenser and a compressor is known in the art, only the elements of the cooling device of this invention which are necessary for removal of condensate water are shown in the drawing.

The condensate collecting pan (12) is positioned in the cooling device (10) below the evaporator (11). Since this invention relates to a compressor-operated cooling device, evaporation of the condensate takes place on the evaporator (11). The warm air (27) is passed through the evaporator (11) and is released through the casing hole (13) as cold air (28).

The blower (16) passes a warm air current (29) with a very high velocity through outlet connecting piece (17). The outlet connecting piece (17) of the blower (16) is connected with the connecting mount (20) of the air channel (19) and feeds the warm air current (29) through the outlet hole (25) of the cooling device (10). If the outlet connecting piece (17) has a circular or rounded cross section, then the cross sections of the air channel (19) and the connecting mount (20) are also circular or rounded. The lower side wall of the air channel (19) is shaped in a concave manner as a drip pan (18) so that the warm air current (29) passes over the open upper side of the drip pan (18). The approximately vertical inlet pipe (21) has a lower end projecting into the drip pan (18) and is integrally connected in the upper side wall of the air channel (19). The inlet pipe (21) traverses the rounded air channel (19), preferably from top to bottom, and projects out at the upper side of the air channel (19) as a connecting piece. The condensate collecting pan (12) of the evaporator (11) has, at its lowest point, an outlet connecting piece (14) onto which the discharge conduit (15) is connected, which is formed as a tube section. The lower end of the tube section is connected to the connecting nozzle of the inlet pipe (21).

The condensate water removed by the evaporator (11) flows from the condensate collecting pan (12) via the outlet connecting piece (14), the discharge conduit (15) and the inlet pipe (21), directly into the drip pan (18). Drip pan (18) has sufficient capacity to hold the discharge condensate water from evaporator (11). The warm air current (29) discharged from the outlet connecting piece (17) is, when the blower (16) is operating, passed at a high velocity over the condensate water collected in the drip pan (18). Thus, the condensate water is heated and air vortices (30) or eddies are formed on the surface and carry fluid droplets of the condensate water. Fluid droplets are dispersed within the discharge current (31) beyond the outlet hole (25) and can thereby be passed through the channel adapter (22) to a discharge hole (25') in housing (26). Clamping rings (23) connect the channel adapters (22) with one another and the sealing ring (24) is used to seal the channel adapter (22) with the casing (26).

The cost for parts and labor necessary for assembly can be maintained low by having the drip pan (18), the air channel (19), the connection mount (20) and the inlet pipe (21) constructed as a single-piece plastic part which can be produced, for example, by an injection molding process.

The air channel (19) and the drip pan (18) can also be produced as separate parts and connected with one another. The air channel (19) is inclined slightly toward the outlet hole (25), so that fluid droplets which can form in the air channel (19) can easily flow back to the drip pan (18) after the blower (16) is shut down.

I claim:

1. A device for removing condensate water from a compressor-operated cooling device having an evaporator and a condensate collecting pan mounted below the evaporator wherein condensate water accumulated during the condensation operation of said evaporator flows to a drip pan mounted below said condensate collecting pan on a base plate of the cooling device next to an outlet hole in one wall of the cooling device, a blower mounted on the side of said drip pan opposite the outlet hole, during the condensate operation, blows a warm air current in the direction of said outlet hole, over the surface of the condensate water collected in the drip pan, said device comprising: a pan-shaped curved concavity integrated in a lower side of a closed air channel (19) forming said drip pan (18), said air channel (19) being tightly connected with an outlet connecting piece (17) of a blower (16) at one end and with an outlet hole (25) at an opposite end, said blower (16) being capable of supplying a warm air current (29) at a velocity sufficient to carry fluid droplets of the condensate water accumulated in said drip pan (18) by an inlet pipe (21) projecting into said drip pan (18).

2. A device in accordance with claim 1 wherein said condensate collecting pan (12) has an outlet connecting piece (14), said air channel (19) has said inlet pipe (21) transversely positioned through an internal space of said air channel (19) from an upper side of said air channel (19), and said drip pan (18) is connected with said outlet connecting piece (14) of said condensate collecting pan (12) by a flexible tube (15).

3. A device for removing condensate water from a compressor-operated cooling device having an evaporator and a condensate collecting pan mounted below the evaporator wherein condensate water accumulated during the condensation operation of said evaporator flows to a drip pan mounted below said condensate collecting pan on a base plate of the cooling device next to an outlet hole in one wall of the cooling device, a blower mounted on the side of said drip pan opposite the outlet hole, during the condensation operation, blows a warm air current in the direction of said outlet hole, over the surface of the condensate water collected in the drip pan, said device comprising: said drip pan (18) integrated as a pan-shaped curved concavity into a lower side of a closed air channel (19) which is tightly connected with an outlet connecting piece (17) of a blower (16) at one end and with an outlet hole (25) at an opposite end, said blower (16) being capable of supplying a warm air current (29) at a velocity sufficient to carry fluid droplets of the condensate water accumulated in said drip pan (18);

said condensate collecting pan (12) having an outlet connecting piece (14), said air channel (19) having an inlet pipe (21) transversely positioned through an internal space of said air channel (19) from an upper side of said air channel (19) to said drip pan (18) mounted on said lower side of said air channel (19), said drip pan (18) connected with said outlet connecting (14) of said condensate collecting pan (12) by a flexible tube (15); and said air channel (19) and said inlet pipe (21) constructed as a single-piece plastic part which is connectable with said outlet connecting piece (17) of said blower (16) by a connecting mount (20).

4. A device in accordance with claim 3 wherein said outlet connecting piece (17) of said blower (16), said outlet hole (25) and said air channel (19) have a rounded cross section and said air channel (19) is inclined slightly toward said outlet hole (25) such that condensate water between said outlet hole (25) and said drip pan (18) can flow back into said drip pan (18) after said blower (16) has been shut down.

* * * * *